United States Patent [19]

Endo et al.

[11] 4,237,213

[45] Dec. 2, 1980

[54] IMAGE FORMING METHOD

[75] Inventors: Ichiro Endo, Yokohama; Hajime Kobayashi, Mitaka; Yasuhiro Yano, Tokyo; Takao Muramatsu, Yokohama, all of Japan

[73] Assignee: Canon Kabushiki Kaisha, Tokyo, Japan

[21] Appl. No.: 948,238

[22] Filed: Oct. 3, 1978

Related U.S. Application Data

[63] Continuation of Ser. No. 763,087, Jan. 27, 1977, abandoned.

[30] Foreign Application Priority Data

Jan. 30, 1976 [JP] Japan ..... 51/8978
Jan. 30, 1976 [JP] Japan ..... 51/8979

[51] Int. Cl.[3] ..... G03C 1/02

[52] U.S. Cl. ..... 430/353; 430/49; 430/126; 430/618; 430/935; 101/DIG. 13

[58] Field of Search ..... 96/114.1, 67, 109, 107, 96/1 R, 95, 66 T

[56] References Cited

U.S. PATENT DOCUMENTS

| | | | |
|---|---|---|---|
| 3,457,075 | 7/1969 | Morgan et al. | 96/114.1 |
| 3,649,280 | 3/1972 | King et al. | 96/66 T |
| 3,707,377 | 12/1972 | Tiers et al. | 96/114.1 |
| 3,767,414 | 10/1973 | Huffman et al. | 96/114.1 |
| 3,801,330 | 4/1974 | Brinckman et al. | 96/66 T |
| 3,870,523 | 3/1975 | Ikenoue et al. | 96/114.1 |
| 3,893,860 | 7/1975 | Sutton et al. | 96/114.1 |
| 3,957,493 | 5/1976 | Masuda et al. | 96/114.1 |
| 4,013,473 | 7/1978 | Willems et al. | 96/114.1 |
| 4,069,759 | 1/1978 | Endo et al. | 96/1 R |
| 4,152,162 | 5/1979 | Masuda et al. | 96/114.1 |

*Primary Examiner*—J. Travis Brown
*Attorney, Agent, or Firm*—Fitzpatrick, Cella, Harper & Scinto

[57] ABSTRACT

An image forming method comprises adding a development accelerator for accelerating the developing function at the time of the heat-development to a heat-development type photosensitive raw material containing therein at least an organic silver salt, a halide, and a binder, at the time when the image formation is to be carried out by the process steps of exposure and heat-development.

5 Claims, No Drawings

IMAGE FORMING METHOD

This is a continuation, of application Ser. No. 763,087, filed Jan. 27, 1977, now abandoned.

This application is related to commonly assigned Application Ser. Nos. 599,061, filed 7/25/75; 608,006, now U.S. Pat. No. 4,036,650; 643,810, filed 12/23/75; 685,460, now U.S. Pat. No. 4,057,016, 761,401, filed 1/21/77; 761,368, filed 1/21/77; and 761,069, filed 1/21/77.

BACKGROUND OF THE INVENTION

1. Field of the Invention

This invention relates to an image forming method and a heat-development type photosensitive material to be used therefor. More particularly, the invention is concerned with the image forming method which uses the heat-development type photosensitive material containing therein an organic silver salt, and such heat-development type photosensitive material suited for the purpose.

2. Description of the Prior Arts

Photosensitive materials containing therein silver halide have heretofore been used widely in forming a picture image. As these photosensitive materials, however, are of wet type in their development and image fixation, there are various disadvantages still to be improved such that the treatment process is complicated and takes much time, that the treatment process must be conducted in a dark room, that undesirable effects are likely to be caused to human body working in such chemical treatment in the dark room, and others.

Various attempts have been made in recent years to carry out the treatment in a dry condition rather than in a wet condition. The most representative of such dry type treatment is as taught in U.S. Pat. No. 3,457,075, wherein a heat-development type photosensitive material containing therein a catalytic quantity of a photosensitive silver halide principally composed of an organic silver salt and a reducing agent is subjected to a heat-treatment after an image exposure thereon to obtain a visible picture image.

This image forming method is of such type that, when the abovementioned heat-development type photosensitive material is subjected to an image exposure, a very small amount of silver is isolated from the photosensitive silver halide in the catalytic quantity to form a latent image, and this small amount of isolated silver functions, during the subsequent heat-development process, as a nucleus for development of silver which is isolated from the organic silver salt and deposited with the aid of the reducing agent, thereby forming a visible picture image.

Accordingly, the image forming process is totally of the dry type, which process has drawn increasing concern from all fields. And, the improvement and development in the heat-development type photosensitive material used therefor are very active. At the same time, this image forming method has been attaining wider applications in various aspects such as use as an electrostatic printing master which is disclosed in U.S. Pat. No. 599,061 filed by the present applicants, and as recording material in many fields.

While the heat-development type photosensitive material to be used for such image forming method has its advantage in that it is capable of carrying out the entire treatment process in the dry condition, it has various disadvantageous problems to occur at the time of the actual image formation owing to the entire substances required for the image formation being made coexistent from the initial stage of preparing the heat-development type photosensitive material. That is, there is a considerable lapse of time from preparation of the heat-development type photosensitive material to the actual image forming operation using the same. In other words, there is a considerable lapse of time ranging from an order of several weeks to even more prolonged time lapse after the photosensitive material is prepared at the factory until it is used for the image formation at the users who purchased the material through a distributor, or after the users purchased the heat-devlopment type photosensitive material until they actually use the material for the image reproduction. It becomes, therefore, very important that the same degree of performance of the photosensitive material as at the initial stage of its preparation be maintained throughout this prolonged time period. For this purpose, there have been taken various measures such as, for example, tight sealing of the heat-development type photosensitive material in, for example, a paper envelope lined its inside with an aluminum laminate, and so forth. As a matter of practice, however, when such tightly sealed envelope is opened at its one end for use of the photosensitive material, there inevitably remain a number of unused sheets, and these unused sheets are liable to be exposed to the natural atmosphere with the results that they no longer maintain their initial performance and becomes deteriorated. Such situation takes place not infrequently. To avoid such undesirable consequence, it is necessary that, when the heat-development type photosensitive material is made into a sheet form, each sheet to be completely sealed in an individual envelope as mentioned above, or that, in the case of such sheets being enveloped in bulk and the envelope being once opened for use of some of the sheets, the envelope be tightly sealed again immediately after the required number of sheets are taken out of the envelope, or that the sheets remaining unused in the open envelope be kept in a desired atmosphere to maintain their performance, and so forth. Any of these measures, however, results in waste of time and labor, which is undesirable from the viewpoint of saving expensive personnel cost and resources, and of required promptness in dissemination of informations, and so forth.

Further, when the heat-development type photosensitive material is used as a forming material of the electrostatic printing master as described in the specification of U.S. patent application Ser. No. 599,061 filed by the present applicants, the abovementioned points constitute extreme inconveniences. That is to say, the abovementioned electrostatic printing master is obtained by subjecting the heat-development type photosensitive material to an image exposure and heat-development treatments to form a silver image pattern therein, the electrostatic printing method of which is to subject the electrostatic printing master having such silver image pattern to electrostatic charging, development of an image, and transfer of the developed image. The principle of the electrostatic printing is based on the fact that, at the time of the electrostatic charging step, the exposed portion (silver image portion) of the master is relatively electrically conductive and relatively small in its electrostatic charge sustaining capability, while the non-exposed portion (non-silver image portion) has such electrostatic charge sustaining capability, owing to which there occurs an electrostatic potential contrast. Therefore, deterioration in the image forming capability with lapse of time of the heat-development type photosensitive material as the forming material of the electrostatic printing master inevitably invites, for example, insufficiency of the silver deposition at the exposed portion of the photosensitive material to unfavorably cause the quality of the transferred image to lower due to decrease in the electrostatic potential contrast.

For the abovementioned reasons, there has been called for development of a heat-development type photosensitive material excellent in its preserving property, i.e., excellent in maintaining its image forming capability comparable to the quality at its initial stage of preparation, or new proposal for the image forming method. Furthermore, from the standpoint of the material for forming the electrostatic printing master proposed by the present inventors in their previous application, the development of the heat-development type photosensitive material, with which the electrostatic printing master having such excellent electrostatic characteristic can be formed, is all the more strongly desired.

In view of the foregoing, the present inventors conducted diligent researches and studies from various aspects on the heat-development type photosensitive material containing therein an organic silver salt, as the result of which they have found that inclusion of a development accelerator represented by a reducing agent from the initial stage of preparing the photosensitive material constitutes the very point of problem in the deterioration of the image forming quality of the material.

While succinct theory for the cause of the deterioration in the image forming capability of the heat-development type photosensitive material due to inclusion of such development accelerator from the initial stage of preparing the photosensitive material has not yet been established, it may be assumed as follows. That is, in the known type of heat-development type photosensitive material, as the development accelerator representable by a reducing agent and which is one of the components of the photosensitive material is included in the material from the initial stage of its preparation, the condition of existence of these components in the heat-development type photosensitive material changes from that at its initial stage of preparation in the course of its storage over a long period of time. In other words, the state of coexistence of the organic silver salt and the development accelerator to impart a preferable performance of the photosensitive material at the initial stage of its preparation appears to change with lapse of time to cause the aforementioned problems to occur, or the development accelerator per se deteriorates with lapse of time due to, for example, its scattering outside of the system through evaporation, or both decomposition and evaporation.

SUMMARY OF THE INVENTION

The present invention has been made in view of the afore-described points of problem, and can solve all of them.

It is therefore an object of the present invention to provide an excellent image forming method of extremely high practicability which is capable of visualizing the image with a desired, effective image density.

It is another object of the present invention to provide an excellent image forming method which is capable of producing an extremely satisfactory picture image of a desired quality at the time of the image formation under any condition.

It is still another object of the present invention to provide a heat-development type photosensitive material which requires no particular treatment to be done for its storage, and which is excellent in exhibiting remarkably superior electrostatic characteristics which it is formed into the abovementioned electrostatic printing master, and is very appropriate as the commercial articles.

According to the present invention, in one aspect thereof, there is provided an image forming method which comprises adding a development accelerator (d) to a heat-development type photosensitive raw material containing therein at least an organic silver salt (a), a halide (b), and a binder (c) at the time of forming an image through the image exposure and heat-development steps.

According to the present invention, in another aspect thereof, there is provided a heat-development type photosensitive material, in which the development accelerating property thereof is imparted thereto, or its development accelerating property is augmented by addition of a development accelerator (d) at the time of the image formation.

DESCRIPTION OF PREFERRED EMBODIMENTS

The present invention is capable of imparting to the photosensitive raw material containing therein an organic silver salt (a), a halide (b), and a binder (c) the development accelerating property, or such property almost comparable or even superior to that at the initial stage of preparing the heat-development type photosensitive material by adding a development accelerator (d) at the time of forming an image thereon through exposure and heat-development.

The development accelerator (d) to be used in the present invention is such one that functions to accelerate the developing action at the exposed portion of the heat-development type photosensitive material at the time of the image exposure and heat-development thereon. The representative substance for this development accelerator is a reducing agent. Besides the reducing agent, there may be used as the development accelerator (d) a stabilizer to preserve a produced image in a stabilized condition, a sensitivity-increased coloring matter, and a color adjustor for controlling color tone of an image at the time of the image formation, and others.

The characteristic feature of the present invention resides in imparting to, or augmenting in, the abovementioned heat-development type photosensitive material the development accelerating property by adding the abovementioned development accelerator (d) when the photosensitive material is subjected to the image forming process. Accordingly, the image forming method according to the present invention may be adopted in either case where the development accelerator is contained at the time of preparing the heat-development type photosensitive material, or where no such development accelerator is contained therein. That is, in the heat-development type photosensitive material, therein the development accelerator is contained previously at the time of preparing the photosensitive material, the development accelerating property is augmented by fresh addition of such development accelerator at the time of the image formation, so that the effect of deterioration in the image forming capability of the heat-development type photosensitive material due to change, with lapse of time, in the development accelerator contained therein can be reduced to the minimum possible extent. Even in case the development accelerator is not changed so much with lapse of time, there can be accrued further improvement in the image forming capability owing to increase in the development accelerating property of the photosensitive material by addition of the development accelerator at the time of the image formation. Moreover, as stated above, since the development accelerator is to impart to the heat-development type photosensitive material the required development accelerating property at the time of its image formation, even when the photosensitive raw material does not include therein the development accelerator at the time of its preparation, no particular preventive measures need be taken against deterioration of the development accelerator during the storage period starting from its preparation to the image formation thereon, which is an advantage of the present invention.

The heat-development type photosensitive raw material according to the present invention may usually be obtained by mixing and dispersing an organic silver salt (a) and a halide (b) in a binder (c), and applying the dispersion onto an appropriate supporting body or a substrate to form the same into an organic silver salt layer.

For the organic silver salt to be used in such heat-development type photosensitive raw material, there can be enumerated silver salts of organic acids, mercapto compounds and imino compounds, and organic silver complex salts as shown in the following. Of these compounds, the silver salts of organic acids, particularly, silver salts of fatty acids, are effective.

Representative compounds of the organic silver salt are actually as follows.

I. Silver salt of organic acid

1. Silver salt of fatty acid (1) Silver salt of saturated aliphatic carboxylic acid For example, silver acetate, silver propionate, silver butyrate, silver valerate, silver caproate, silver enanthate, silver caprylate, silver pelargonate, silver caprate, silver undecylate, silver laurate, silver tridecylate, silver myristate, silver pentadecylate, silver palmitate, silver heptadecylate, silver stearate, silver nonoadecylate, silver arachidate, silver behenate, silver lignocerate, silver cerotate, silver heptocosanate, silver montanate, silver melissinate and silver laccerate.

(2) Silver salt of unsaturated aliphatic carboxylic acid

For example, silver acrylate, silver crotonate, silver 3-hexenate, silver 2-octenate, silver oleate, silver 4-tetradecenate, silver stearolate, silver docosenate, silver behenolate, silver 9-undecynate, and silver arachidonate.

(3) Silver salt of aliphatic dicarboxylic acid For example, silver oxalate.

(4) Silver salt of oxycarboxylic acid For example, silver hydroxy-stearate.

2. Silver salt of aromatic carboxylic acid (1) Silver salt of aromatic carboxylic acid For example, silver benzoate, silver 0-aminobenzoate, silver p-nitrobenzoate, silver phenylbenzoate, silver acetamidobenzoate, silver salicylate, silver picolinate, and silver 4-n-octadecyloxydiphenyl-4-carboxylate.

(2) Silver salt of aromatic dicarboxylic acid

For example, silver phthalate, and silver quinolinate.

3. Silver salt of thiocarboxylic acid

For example, silver $\alpha,\alpha'$-dithiodipropionate, silver $\beta,\beta'$-dithiodipropionate and silver thiobenzoate.

4. Silver salt of sulfonic acid

For example, silver p-toluenesulfonate, silver dodecylbenzenesulfonate and silver taurinate.

5. Silver salt of sulfinic acid

For example, silver p-acetaminobenzenesulfinate.

6. Silver salt of carbamic acid

For example, silver diethyldithiocarbamate.

II. Silver salt of mercapto compound

For example, silver 2-mercaptobenzoxazole, silver 2-mercaptobenzothiazole and silver 3-mercaptobenzimidazole.

III. Silver salt of imino compound

For example, silver 1,2,4-triazole, silver benzimidazole, silver benztriazole, silver 5-nitrobenzimidazole, silver 5-nitrobenztriazole and silver 0-sulfobenzimide.

IV. Organic silver complex salt

For example, silver di-8-hydroxyquinoline and silver phthalazone.

For the halides (b) to be used, the following are representative.

(1) Inorganic halide

The inorganic halide is preferably that having the general formula: MXm wherein X represents a halogen (for example, Cl, Br, I), M represents hydrogen, ammonium or a metal (for example, potassium, sodium, lithium, calcium, strontium, cadmium, chromium, rubidium, copper, nickel, magnesium, zinc, lead, platinum, palladium, bismuth, thallium, ruthenium, gallium, indium, rhodium, beryllium, cobalt, mercury, barium, silver, cesium, lanthanum, iridium, aluminum and the like), and m is 1 when M is hydrogen or ammonium and represents the valency of a metal when M is the metal.

In addition, silver chlorobromide, silver chlorobromoidide, silver bromoiodide, silver chloroiodide may be also preferably used.

(2) Halogen-containing organic compound

For example, carbon tetrachloride, chloroform, trichloroethylene, triphenylmethyl chloride, triphenylmethyl bromide, iodoform, bromoform, cethylethyldimethylammonium bromide and the like.

While the mechanism of action of these halides (b) has yet to be clarified, it may be assumed, with respect to the silver halides from among those enumerated above, that the exposure action produces an isolated silver, and this isolated silver constitutes a nucleus for development at the time of the heat-development to promote dissociation of silver from the organic silver salt to thereby form a silver image. Regarding the halides other than silver halide, it may be assumed that, at the time of forming an organic silver salt layer, the halide reacts with the organic silver salt to produce silver halide, and, upon being subjected to the exposure step, silver is isolated from the silver halide in the same manner as mentioned in the foregoing, which becomes a nucleus for the development to form the silver image.

The abovementioned halide (b) may be used either singly or in combination of more than two kinds of these compounds. Adding quantity of the halide (b) is limited to such an extent that, at the time of the exposure, the nucleus for the development in an amount which does not affect the heat-development is formed, in other words, the minimum required photosensitivity is provided.

The reason for the abovementioned limitation to the amount of halide to be added is that, when it is added in more amount than necessary, the photosensitivity becomes higher than required owing to the presence of silver halide in the heat-development type photosensitive raw material which is photosensitive, owing to which the photosensitive material is considerably sensitized even with a very slight amount of light, e.g., when the heat-development type photosensitive raw material is unexpectedly exposed to light at the time of its storage, it immediately discolors, even if the exposure is in a very brief instant and under a very slight amount of light, to cause the so-called ground fogging; while, when it is added in less amount than necessary, the nucleus for the development cannot be formed in a quantity sufficient to accomplish the heat-development in an efficient manner. For the reasons as mentioned above, the adding quantity of the halide to be determined should usually be from 1 mol to $10^{-6}$ mol with respect to 1 mol of organic silver salt, or preferably from $10^{-1}$ mol to $10^{-6}$ mol, or optimumly from $10^{-1}$ to $10^{-5}$ mol.

While the organic silver salt layer is formed by first dispersing the organic silver salt (a) into the binder (c) as mentioned above using an appropirate solvent, and then applying the dispersion liquid onto a substrate, the suitable method for the purpose may be of any known technique of forming a thin film from a synthetic resin material. Such known coating methods are the application by rotation, in which the substrate is immersed in an emulsion, the air-knife method, the wire-bar coating method, pouring and spreading coating method, and so forth. Thickness of the film may be optionally adjusted depending on the purpose.

For the binding agent, or binder, to cause the organic silver salt (a) to disperse therein so as to form the organic silver salt layer, those material which are excellent in the film-forming capability, and which does not soften beyond its permissible extent at the time of the heat-developement to invite lowering in the binding property thereof, should be used. In particular, when the heat-development is to be carried out by means of a heated roller, there is possibility such that the image quality is liable to be disturbed due to softening of the binder (c), avoidance of which is most important. Furthermore, at the time of the heat-development subsequent to formation of a latent image by the image-exposure, selection of the binder (c) having such function that does not suppress isolation of silver from the organic silver salt (a) proper, but assist isolation of silver from the organic silver salt (a) at the exposed portion of the photosensitive material is highly recommendable.

Also, when such heat-development type photosensitive material is used as the raw material for forming the aforementioned electrostatic printing master, the following conditions should desirably be satisfied, in addition to the afore-described various conditions. That is, when the master is prepared from the heat-development type photosensitive material and then it is used as the electrostatic printing master, since the electrostatic printing method is relied on the electrostatic contrast between the non-exposed portion (non-silver image portion) and the exposed portion (silver-image portion) to be obtained by the electric charging of the master surface by the corona discharge, etc., it is all the more important that the electrostatic charge be retained as much as possible at the non-exposed portion, and that, on the contrary, the electrostatic charge be not retained as far as possible at the exposed portion. It is therefore necessary that the binder (c) possesses an electric resistivity of an extent more than that is capable of retaining the electric charge therein.

In the abovementioned sense, use of a binder having a resistivity higher than that of the resin normally used in the photosensitive body having thereon a photo-conductive layer of a CdS-resin dispersion system, or a ZnO-resin dispersion system in the field of the electrophotography is highly preferable, although the binder is not limited to these kinds alone. That is, the electrostatic printing master may be essentially satisfactory, if it has the electrostatic charge sustaining power of a certain extent at the non-exposed portion, and the electrostatic contrast between the non-exposed portion and the exposed portion is suitable for the practical purpose.

Consequently, for such electrostatic contrast to be obtained, it is desirable that the binder (c) for the heat-development type photosensitive material be chosen to enable an electrostatic printing master, whose resistivity at the non-exposed portion is higher by two places and above, or optimumly, higher by three places and above, than that at the exposed portion on the master, to be formed. The resistivity of the binder (c) should usually be $10^{10}$ ohm-cm and above, more preferably $10^{11}$ ohm-cm and above, and, optimumly, $10^{13}$ ohm-cm and above.

In order that neither destruction in insulation nor pin-hole may occur at the non-exposed portion at the time of the electric charging, it is necessary to determine strength of the binder against destruction in insulation in accordance with intensity of the electric charge imparted by the corona discharge, etc. It is usually 10 kV/mm and above, more preferably, 15 kV/mm and above, and optimumly, 20 kV/mm and above.

Further, the binder (c) should desirably be of non-hygroscopic property. In other words, when the electrostatic printing master is utilized, for example, in a highly humid atmosphere, if it is lack in the non-hygroscopic property, the electric resistance at the non-exposed portion of the master becomes lowered on account of moisture-absorption of the master, which leads to lowering in the electrostatic contrast, and, in addition, causes the electrostatic charge to flow toward the surface of the master. Accordingly, the binder (c) should be so determined that the degree of non-hygroscopicity may be selected in accordance with the atmosphere, in which the master is to be used, or with the area or region, where the master is to be used (whether the area is highly humid or not). In the present invention, when the abovementioned heat-development type photosensitive material is used as the forming material of the electrostatic printing master, the equilibrated moisture content should preferably be 3.0% or below, and optimumly, 2.0% or below, with respect to the relative humidity of from 20 to 100%.

Representative binders for use in the present invention are enumerated as follows.

For example, polyvinyl butyral, polyvinyl acetate cellulose diacetate, cellulose triacetate, cellulose acetate butyrate, polyvinyl alcohol, ethyl cellulose, methyl cellulose, benzyl cellulose, polyvinyl acetal, cellulose propionate, cellulose acetate propionate, hydroxyethyl cellulose, ethylhydroxy cellulose, carboxymethyl cellulose, polyvinyl formal, polyvinylmethylether, styrene-butadiene copolymer and polymethyl methacrylate. If necessary, two or more of these compounds may be mixed for use.

When the heat-development type photosensitive material is used as the photosensitive material for forming the aforementioned electrostatic printing master, it is preferable that the binder (c) having satisfactory insulating property be selected out of the above listed group. For example, when polyvinyl butyral is employed as the binder (c), it should preferably possess a mean degree of polymerization of from 500 to 1,000, a degree of butyralation of 60 mol% and above, and a residual acetyl group of 3 mol% and below.

If desired, a plasticizer may be added. Typical plasticizers are dioctyl phthalate, tricresyl phosphate, diphenyl chloride, methylnaphthalene, p-terphenyl, and diphenyl.

The adding quantity of the binder (c) may be properly determined on the basis of various conditions desired. It usually ranges from 0.02 to 20 parts by weight, or more preferably, from 0.1 to 5 parts by weight, with respect to 1 part by weight of organic silver salt.

As the solvents for dispersing the organic silver salt in the binder (c), there may be mentioned methylene chloride, chloroform, dichloroethane, 1,1,2-trichloroethane, trichloroethylene, tetrachloroethane, carbon tetrachloride, 1,2-dichloropropane, 1,1,1-trichloroethane, tetrachloroethylene, ethyl acetate, butyl acetate, isoamyl acetate, cellosolve acetate, toluene, xylene, acetone, methyl ethyl ketone, dioxane, tetrahydrofuran, dimethylamide, N-methylpyrrolidone, alcohols such as methyl alcohol, ethyl alcohol, isopropyl alcohol, butyl alcohol and the like, and water.

The base may be a metal plate such as aluminum, copper, zinc, silver and the like, a metal laminate paper, a paper treated to prevent permeation of a solvent, a paper treated with a conductive polymer, a synthetic resin film containing a surface active agent; and a glass, a paper, a synthetic resin sheet and a film such as cellulose acetate film, polyethyleneterephthalate film, polycarbonate film, polystyrene film and the like which have on the surface a vapor-deposited metal, metal oxide or metal halide. Also, insulating glass, paper, synthetic resin and the like may be used. In particular, when the heat development type photosensitive material was wound on a drum and used as an electrostatic printing master, an appropriate flexible metal sheet, paper on other conductive materials which can be wound on a drum are preferable.

When an electrically conductive layer is to be provided on the surface of a non-conductive substrate such as a synthetic resin film, paper, or others, it may be placed on either surface where the organic silver salt layer is present or the surface opposite thereto, depending on the purpose of use. In case, however, the electrically conductive layer directly contacts the organic silver salt layer, it is preferable that the forming material of the electrically conductive layer be so selected that it may not react with organic silver salt (a).

When an electrically conductive substrate is employed, the material for such substrate may be any kind if it has an inherent surface resistivity smaller than that at the non-silver image portion, i.e., $10^9$ ohm-cm and below, or more preferably $10^5$ ohm-cm and below, when the material is formed into the electrostatic printing master, and has no tendency to react with organic silver salt (a).

In the image forming method of the present invention, the timing for adding the development accelerator (d) to the abovementioned heat-development type photosensitive material should preferably be as close to the timing for the heat-development as possible. In that sense, addition of the development accelerator during a period of from immediately prior to the image exposure operation to immediately prior to commencement of the heat-development, or the addition of the development accelerator simultaneously with the heat-development, accrues more effective and favorable results. In particular, when it is apprehended that the development accelerator (d) tends to deteriorate by light, the addition of the accelerator after the image exposure but before the heat-development is considered desirable.

For the abcvementioned development accelerator (d) to be added to the heat-development type photosensitive material, it is dissolved into an appropriate solvent together with a binder, or without the binder to thereby make it into solution. Or, it may be dispersed in an appropriate solvent, e.g., "ISOPAR" (a group of high purity isoparaffinic material produced by Humble Oil & Refining Co., U.S.A.). Any other appropriate, known method of addition may be feasibly adopted. More concretely, the following various methods may be adopted: the so-called dipping method, wherein the substrate is immersed in a solution containing the development accelerator (d); the rotary coating method; the air-knife coating method; wire-bar coating method, the pouring and spreading method; spray coating method, brush coating method, the doctor-blade coating method, and so forth. Particularly, when the image formation is to be conducted continuously and at a high speed, the roller coating method, dipping method, spray coating method, rotary coating method, etc. may be preferably adopted.

Furthermore, as another method, the heat development process, wherein a material in sheet form containing therein the development accelerator (d) is caused to contact the surface of the organic silver salt layer of the heat-development type photosensitive raw material, and then it is subjected to the heat-development, may be effectively adopted. In this case, the sheet material needs be closely contacted on the organic silver salt layer surface prior to the image exposure, and should have light transmitting property to the exposure light. The advantage in the so-called "dual sheet type" method resides in that the image quality as at the time of its formation can be maintained semi-permanently, because, when the sheet contains the reducing agent as the development accelerator (d), unused reducing agent can be removed by peeling the abovementioned sheet off the organic silver salt layer surface after the heat-development treatment, whereby the so-called fogging due to the residual reducing agent after the development can be prevented.

As the other method of adding the development accelerator (d) to the heat-development type photosensitive material, the accelerator is rendered an atomized state or a vaporized state, and is then applied to the photosensitive material.

For the development accelerator (d) for use in the present invention, those which have so far been employed in the name of reducing agents, stabilizers, sensitivity-increased coloring matters, tone adjusters, and so forth, may be used. These development accelerators may be used in a mixture of two or more kinds within such an extent that the components in the mixture do not mutually affect unfavorably. It is of course permissible that any appropriate ones selected from these development accelerators are individually added to the photosensitive material in the order as desired.

The effective reducing agents for the purpose of the present invention are phenols, bisphenols, naphthols, di- or poly-hydroxybenzenes, and so forth.

As the examples of the reducing agent, there may be mentioned the following.

(1) Phenols

For example, aminophenol, 2,6-di-t-butyl-p-cresol and p-methylaminophenol sulfate(metol).

(2) Bisphenols

For example, 2,2'-methylene bis(6-t-butyl-4-methylphenol), 4,4'-butylidene bis(6-t-butyl-3-methylphenol), 4,4'-bis(6-t-butyl-3-methylphenol), 4,4'-thio bis(6-t-butyl-2-methylphenol) and 2,2'-methylene bis(6-t-butyl-4-ethylphenol).

(3) Naphthols

For example, 2,2'-dihydroxy-1,1'-binaphthyl, 6,6'-dibromo-2,2'-dihydroxy-1,1'-binaphthyl, bis(2-hydroxy-1-naphthyl) methane and methylhydroxynaphthalene.

(4) Di or polyhydroxybenzenes

For example, hydroquinone, methylhydroquinone, chlorohydroquinone, bromohydroquinone, pyrogallol and catechol.

(5) Others 1-phenyl-3-pyrazolidone(phenidone).

Further, a mixture of these compounds may be used.

Besides the above-enumerated reducing agents, bis-naphthol reducing agents represented by bis-$\beta$-naphthol such as, for example, 2,2'-dihydroxyl-1,1'-binaphthyl, and so on, as disclosed in Japanese laid-open patent applications No. 46-6074 and No. 47-33621, are effective for the purpose. Furthermore, with a view to increasing the maximum density ($D_{max}$) and suppressing increase in the minimum density ($D_{min}$), or to increasing the exposure latitude, use of the following compounds together with the abovementioned bis-naphthol reducing agents is also effective: dihydroxybenzene compounds such as 2,4-dihydroxybenzaldehyde; 2,4-dihydroxybenzophenone; 2,4-dihydroxyacetophenone; 2',4'-dihydroxy-4-methylbenzophenone; 2,4-dihydroxypropiophenone; 2,4-dihydroxybutylphenone. Also, from the standpoint of improving a temperature latitude for the development, sulfonamide phenol reducing agents as disclosed in U.S. Pat. No. 3,801,321, for example, can be effectively used.

For the method which utilizes the dual sheet type photo-sensitive material, there can be further used as the effective reducing agent a substance which is vested with the required reducing property by light irradiation. Such substance is disclosed in, for example, Japanese laid-open patent application No. 50-140113. Since this substance is obtained by combination of quinones, azides, and hydrogen donors, and can first be vested with the reducing property by light irradiation, if such light that imparts to the abovementioned substance the required reducing property, for example, is used as the image exposure light, the reducing agent is present only on the surface of the exposure portion of the organic silver salt layer, on account of which no fogging occurs at the non-exposed portion at the time of the heat-development, hence the image of a satisfactory quality can be obtained.

In the preceding, mention is made as to the use of light which imparts the reducing property to the abovementioned substance as the image exposure light. Besides this light, it is possible to use, for example, a double light sources, by which the image exposure light and the light to impart the reducing agent to the substance for irradiation are superposed and irradiated onto the photosensitive material. It goes without saying that such substance may be provided on the organic silver salt layer surface before the image exposure, followed by the ordinary image exposure and heat-development steps, or it may be provided on the organic silver salt layer surface prior to termination of the heat-development, and then developed under heat.

Preferred development accelerators (d) for use in the present invention include the following:

Azole thioether disclosed in Japenese Patent Laid Open No. Sho 47-318; tetrabromomethane and hexabromomethane disclosed in U.S. Pat. No. 3,707,377; N-halosuccinimide disclosed in Japanese Patent Laid Open No. Sho 49-10724; N-halogen amide disclosed in U.S. Pat. No. 3,957,493, 4-aryl-1-carbamoyl-2-tetrazoline-5-thione disclosed in Japanese Patent Laid Open No. Sho 50-105129; phthalazinones, sulfinic acid and salts thereof disclosed in Japanese Patent Laid Open No. Sho 50-12331; quinoline dyes disclosed in Japanese Patent Laid Open No. Sho 49-84637; dyes disclosed in U.S. Pat. No. 3,870,523; merocyanine dyes having a pyrazolone nucleus as an acidic nucleus disclosed in Japanese Patent Laid Open No. Sho 50-156424; halogenated polymethine dyes disclosed in Japanese Patent Laid Open No. Sho 47-5478; merocyanine dyes disclosed in Japanese Patent Laid Open No. Sho 47-5737; neutro styryl dyes disclosed in Japanese Patent Laid Open No. Sho 47-5738; dye sensitizers such as merocyanine dyes having a rhodanine, thiohydantoin, or 2-thio-2,4-oxazolidinedione nucleus disclosed in Japanese Patent Laid Open No. Sho 48-28221; benzophenones having a benzene ring containing hydroxy and/or alkoxy substituent disclosed in Japanese Patent Laid Open No. Sho 49-115540; phthalazinone or phthalazinone compounds disclosed in Japanese Patent Laid Open No. Sho 49-22928; and cyclohexyl substituted isocyanate derivatives of phthalazinone disclosed in Japanese Patent Laid Open No. Sho 49-102329.

These development accelerators (d) are added to the heat-development type photosensitive material by the aforedescribed methods. The solvent and binder, in which the development accelerators are dissolved and dispersed, may be properly selected from those as enumerated in the foregoing for use in the formation of the organic silver salt layer, depending on preference.

For the binder to be dispersed in any appropriate solvent along with the development accelerator (d), the below-listed substances are used:

polyvinyl chloride, polyvinyl acetate, vinyl chloride-vinyl acetate copolymer, polyvinyl butyral, polystyrene, polymethyl methacrylate, polyurethane rubber, xylene resin, benzyl cellulose, ethyl cellulose, cellulose acetate butyrate, cellulose acetate, polyvinylidene chloride, chlorinated polypropylene, polyvinyl pyrrolidone, cellulose propionate, polyvinyl formal, cellulose acetate phthalate, polycarbonate, cellulose acetate propionate, gelatine and derivatives thereof, acrylamide polymer, chlorinated rubber, isobutylene, butadienestyrene copolymer, polyvinyl alcohol and the like.

For the solvent, there can be chosen any arbitrary one from those to be used for dispersing the abovementioned organic silver salt (a) and the binder (c).

The present invention will be understood more readily by reference to the following examples. However, these examples are intended to illustrate the invention and are not to be construed to limit the scope of the invention.

EXAMPLE 1

25 g of silver behenate, 120 g of toluene, and 120 g of methyl ethyl ketone were mixed and dispersed in a ball mill for 72 hours. Subsequently, 100 g of polyvinylbutyral (10 wt.% ethyl alcohol solution) was added to the mixture and sufficiently mixed to obtain a polymer dispersion liquid of organic silver salt. Thereafter, 120 mg of mercury acetate, 150 mg of ammonium bromide, and 2.5 g of phthalazinone were added to this polymer dispersion liquid, and further mixed to obtain a composition for forming a heat-development type photosensitive raw material. Then, this solution was coated on art paper by the use of a coating rod and dried, whereby the heat-development type photosensitive raw material was obtained.

The thus prepared heat-development type photosensitive material was left in a dark place for 30 days. After this storage, the following composition (I) was coated on the photosensitive layer surface of the photosensitive material by the use of a roll-coater, and was immediately dried with hot blast air.

The composition (I) consists of 1.5 g of 2,2'-methylene bis-(6-t-butyl-p-cresol), 10 g of cellulose acetate (10 wt% acetone solution), and 30 g of acetone.

Following the drying operation of the coating, this photosensitive material was subjected to image-exposure through a positive image by means of a tungsten lamp (2,500 lux) for 12 seconds, after which the heat-development was conducted by means of a roller type heat-development device at a temperature of 130° C. for 3 seconds to thereby obtain a visible, negative print image. This was designated as "specimen S-1".

For the sake of comparison, the forming composition of the abovementioned heat-development type photosensitive raw material was coated on art paper and dried, after which the abovementioned composition (I) was immediately coated over this photosensitive layer surface by means of the roll-coater, and dried to thereby prepare the heat-development type photosensitive material. After this, the photosensitive material was left for 30 days in a dark place, whereby "specimen S-2" was prepared in the same manner as in the case of the specimen S-1.

When the maximum reflection blackening density ($D_{max}$) and the ground fogging ($D_{min}$) of both specimens S-1 and S-2 were measured by an auto-equilibrium densitometer, it was recognized that, as shown in Table 1 below, the specimen S-1 possessed a high contrast in comparison with the specimen S-2, and the image was farily free from the ground fogging.

TABLE 1

| Specimen | Density | |
|---|---|---|
| | $D_{max}$ | $D_{min}$ |
| S-1 | 1.8 | 0.12 |

TABLE 1-continued

| Specimen | Density | |
|---|---|---|
| | $D_{max}$ | $D_{min}$ |
| S-2 | 1.0 | 0.34 |

Accordingly, the heat-development type photosensitive material and the image forming method in this embodiment is apparently superior in its image quality and its preservability.

EXAMPLE 2

The heat-development type photosensitive raw material was prepared in the same manner as in Example 1 above, after which it was left in a dark place for 30 days. Then, the following composition (II) was spray-coated on the photosensitive layer surface of the photosensitive raw material, and immediately dried with hot blast air.

The composition (II) consists of: 1.5 g of 2,2'-methylene-bis-(6-t-butyl-p-cresol) and 30 g of acetone.

Following the drying operation, the exposure and heat-development operations were conducted immediately in the same manner as in Example 1, thereby obtaining a specimen S-3.

For the sake of comparison, the composition (II) was spray-coated on the photosensitive layer surface of the abovementioned heat-development photosensitive raw material immediately after its preparation, dried, and left for 30 days in a dark place. Thereafter, the exposure and development were conducted in the same manner as in Example B 1 above to thereby obtain a specimen S-4.

When comparison was made between the specimen S-3 and S-4 in the same manner as in Example 1, the specimen S-3 was found to give a favorable result as shown in the following Table 2.

TABLE 2

| Specimen | Density | |
|---|---|---|
| | $D_{max}$ | $D_{min}$ |
| S-3 | 1.6 | 0.16 |
| S-4 | 0.8 | 0.45 |

EXAMPLE 3

25 g of silver behenate, 120 g of toluene, and 120 g of methyl ethyl ketone were mixed and sufficiently dispersed in a ball mill for 72 hours and longer. Subsequently, 100 g of polyvinylbutyral (10 wt.% ethyl alcohol solution) was added to this mixture and sufficiently agitated to prepare a polymer dispersion liquid of organic silver salt. Thereafter, 120 mg of mercury acetate, 200 mg of calcium bromide, 2.5 g of phthalazinone, and 60 mg of 3,3'-diethyl-2,2'-thiacarbocyanine iodide were added to this polymer dispersion liquid, and further mixed, thereby obtaining the forming composition for the heat-development type photosensitive raw material.

Then, this solution was coated on art paper by the use of a coatig rod, and dried to thereby prepare the heat-development type photosensitive raw material.

The thus prepared heat-development type photosensitive raw material was left in a dark place for one week under conditions of a temperature of 50° C. and relative humidity (RH) of 80%.

After this one-week storage, the photosensitive material was subjected to the image exposure operation through a positive image by using a tungsten lamp (2,500 lux) for 2 to 3 seconds, after which the photosensitive material was immediately immersed in a solution of the following composition (III), pulled up from the solution, and dried with hot blast air. Subsequently, by using the roller type heat-development device, the heat-development was conducted for 2 seconds at 130° C. to obtain a visible, negative print image. This was made the specimen S-5.

The composition (III) consists of: 1.5 g of 2,2'-methylene-bis-(6-t-butyl-p-cresol), 0.3 g of phthalazinone, 10 g of cellulose acetate (10 wt.% acetone solution), and 30 g of acetone.

For the sake of comparison, the abovementioned forming composition for the heat-development type photosensitive raw material was coated on art paper, then dried, and immediately coated with the composition (III) to prepare the heat-development type photosensitive material. Thereafter, the photosensitive material was also left in a dark place for one week under conditions of 50° C. and a relative humidity (RH) of 80%. After this storage in the dark place, the photosensitive material was subjected to the exposure and heat-development under the same conditions as in the specimen S-5, thereby obtaining a visible image. This was made the specimen S-6.

When both specimens S-5 and S-6 were compared in the same manner as in Example 1 above, the specimen S-5 gave a favorable result as shown in Table 3 below, and the heat-development type photosensitive material and the image forming method of this example was recognized to be excellent.

TABLE 3

| Specimen | Density | |
|---|---|---|
| | $D_{max}$ | $D_{min}$ |
| S-5 | 1.8 | 0.24 |
| S-6 | 1.2 | 0.50 |

EXAMPLE 4

The same procedures were followed as in Example 3, with the exception that the same quantity of silver stearate was used in place of silver behenate in Example 3.

It was recognized that the heat-development type photosensitive material using silver stearate was also excellent.

EXAMPLE 5

The same procedures were followed as in Example 1, with the exception that the same quantity of silver laurate was used in place of silver behenate. As the result, a favorable result was obtained with the heat-development type photosensitive material using silver laurate.

EXAMPLE 6

The undermentioned forming composition for the heat-development type photosensitive raw material was applied on art paper using a coating rod, and dried to obtain the raw material for the heat-development type photosensitive material.

The forming composition for preparing the heat-development type photosensitive raw material consists of: 25 g of silver behenate, 120 g of toluene, 120 g of methyl ethyl ketone, 100 g of polyvinyl butyral (10 wt.% ethyl alcohol solution), 100 mg of mercury acetate, 150 mg of sodium bromide, 2.5 g of phthalazinone, and 60 mg of 3,3'-diethyl-2,2'-thiacarbocyanine iodide.

Subsequently, the abovementioned photosensitive raw material was left in a dark place for two weeks under conditions of 50° C. and a relative humidity (RH) of 80%. Thereafter, the following treatments were made on this photosensitive raw material.

The composition (I) used in Example 1 was applied on a polyester film by the use of a coating rod and dried to obtain a coated sheet. Then, the surface of this polyester sheet coated with the composition (I) and the photosensitive surface of the photosensitive raw material which had been subjected to the compulsory test as mentioned above were sufficiently contacted each other. After this closure contact, an image exposure was conducted for three seconds by using a tungsten lamp (2,500 lux) from the side of the polyester film through a positive image. Then, while the photosensitive raw material and the abovementioned polyester sheet were being contacted each other, the heat-development was conducted for 2 seconds at 130° C. using a roller type heat development device to obtain a visible negative print image, which was made a specimen S-7.

On the other hand, for the sake of comparison, the abovementioned forming composition for the heat-development type photosensitive raw material was applied on art paper, and dried. Immediately after this drying operation, a composition (I) was applied and dried, thereby preparing a comparative heat development type photosensitive material. Following this, the photosensitive material was subjected to the compulsory test in a dark place at 50° C. and under a relative humidity of 80%, after which a specimen S-8 was prepared in the same manner as in the case of preparing the abovementioned specimen S-7.

When the specimens S-7 and S-8 were compared in the same manner as in Example 1, the results as shown in Table 4 below were obtained.

TABLE 4

| Specimen | Density | |
|---|---|---|
| | $D_{max}$ | $D_{min}$ |
| S-7 | 1.8 | 0.24 |
| S-8 | 1.1 | 0.49 |

From the results shown in Table 4, it was recognized that the heat-development type photosensitive raw material and the image forming method according to this Example were as excellent as those of Example 1.

EXAMPLE 7

The raw material for the heat-development photosensitive material was prepared in the same way as in Example 6 above, and the photosensitive material was left for two weeks in a dark place under conditions of 50° C. and a relative humidity of 80%. Thereafter, the following treatments were effected.

An image exposure was done for three seconds on the abovementioned raw material for the photosensitive material, which had undergone the abovementioned compulsory test, through a positive image by using a tungsten lamp (2,500 lux). Subsequently, the surface of art paper, on which the composition (I) had been applied beforehand and dried, was sufficiently contacted onto this photosensitive layer surface of the raw material for the photosensitive material which had already been exposed. After this, the heat-development was conducted for two seconds at 130° C. using a roller type heat-development device, and then the art paper of the side, on which the composition (I) of Example 1 was applied, was peeled off, whereupon a visible negative print image was obtained in the raw material surface for the photosensitive material, which was made the specimen S-9. The same compulsory test as that in the Example was carried out on the photosensitive material of Example 6, and the exposure and development operations were also conducted same as Example 6, thereby preparing the specimen S-10.

Next, in the same manner as in Example 1, the specimens S-8 and S-10 were compared, and the favorable results as shown in Table 5 below were also obtained for this Example.

TABLE 5

| Specimen | Density | |
|---|---|---|
| | $D_{max}$ | $D_{min}$ |
| S-9 | 1.6 | 0.26 |
| S-10 | 0.9 | 0.46 |

Further, 0.5 g of 2,4-dihydroxybenzophenone was added to the composition (I) with the other factors remained same as in the previous example, whereby a specimen S-11 was prepared. Favorable results of $D_{max}$ of 1.9 and $D_{min}$ of 0.25 were obtained.

EXAMPLE 8

The raw material for the heat-development type photosensitive material was prepared in exactly the same manner as in Example 6 above, with the exception that 160 mg of rubidium bromide was added in place of calcium bromide. Thereafter, this photosensitive raw material was left in a dark place for three months.

Thereafter, an image exposure was conducted for three seconds on this photosensitive raw material, which had been left in a dark place, through a positive image by the use of a tungsten lamp (2,500 lux). Then, the surface of the art paper, on which the abovementioned composition (III) had been coated and the photosensitive surface of the photosensitive raw material which had been already exposed were contacted each other by means of a pressure roller, subsequent to which the heat-development was carried out immediately for two seconds at 130° C. by means of a roller type heat-development device, and thereafter the art paper having a layer, in which a reducing agent is contained, was peeled off, whereupon there was obtained a visible negative print image on the surface of the photosensitive raw material. This was made a specimen S-12.

Next, for the purpose of comparison, a heat-development type photosensitive raw material was prepared by overcoating the composition (II) of Example 3 on the surface of the heat-development type photosensitive raw material of this example. This photosensitive material was left in a dark place for three months, after which a specimen S-13 was prepared from this photosensitive material in the same manner as in the preparation of the specimen S-12.

Same as in Example 1 above, comparison was made between the specimens S-12 and S-13. Favorable results were obtained as shown in Table 6 below.

TABLE 6

| Specimen | Density | |
|---|---|---|
| | $D_{max}$ | $D_{min}$ |
| S-12 | 1.8 | 0.28 |
| S-13 | 1.1 | 0.44 |

EXAMPLE 9

The undermentioned forming composition for the heat-development type photosensitive raw material was coated on art paper by the use of a coating rod, and dried to thereby obtain the heat-development type photosensitive raw material.

The forming composition for the heat-development type photosensitive raw material was composed of: 25 g of silver behenate, 120 g of toluene, 120 g of methyl ethyl ketone, 50 mg of 5-acetyl-4-methyl-3-(3-oxobutyl)thiazoline-2-thione, and 160 mg of rubidium bromide.

The undermentioned separate composition (IV) was further coated on the polyester film by the use of a coating rod, and dried to thereby prepare the film having a layer which contains therein a reducing agent.

Composition (IV): 1.5 g of 2,2'-methylene-bis(6-t-butyl-p-cresol), 10 g of cellulose acetate (10 wt.% acetone solution), 0.4 g of phthalazinone, 8 mg of 3,3'-diethyl-2,2'-thiacarbocyanine iodide, and 30 mg of acetone.

The abovementioned heat-development type photosensitive raw material was left in a dark place for five months. Thereafter, the photosensitive layer surface of this photosensitive raw material and the surface of the abovementioned polyester film where the composition (IV) had been coated were sufficiently contacted each other. Next, an image exposure was conducted on this photosensitive material for 3 seconds by the use of a tungsten lamp (2,500 lux) from the side of the film surface through a positive image, and, subsequently, the heat-development was carried out for two seconds at 130° C. using a roller type heating device, whereby a negative print image was obtained. This was made a specimen S-14.

For the sake of comparison, the composition (IV) was coated on the abovementioned photosensitive raw material, and dried to thereby obtain the heat-development type photosensitive material. This photosensitive material was left in a dark place for five months, after which a specimen S-15 was prepared in the same manner as in the case of preparing the specimen S-14.

In the same manner as in Example 1 above, comparison was made between the specimens S-14 and S-15, the results of which were favorable for the specimen S-14 as shown in Table 7 below.

TABLE 7

| Specimen | Density | |
|---|---|---|
| | $D_{max}$ | $D_{min}$ |
| S-14 | 1.8 | 0.27 |
| S-15 | 0.9 | 0.52 |

EXAMPLE 10

The heat-development type photosensitive raw material was prepared in exactly the same manner as in Example 9, with the exception that silver caproate was used in place of silver behenate in the same quantity. The same measurements as in Example 9 above were made on this photosensitive raw material, and the same favorable results as those in Example 9 were obtained.

EXAMPLE 11

The heat-development type photosensitive raw material was prepared by applying the undermentioned forming composition for the heat-development type photosensitive raw material onto art paper by the use of a coating rod, and then drying the coating sufficiently.

The forming composition for the heat-development type photosensitive raw material was composed of 25 g of silver behenate, 120 g of toluene, 120 g of methyl ethyl ketone, 120 mg of mercury acetate, 50 mg of 2-bromo-2-phenylsulfonylacetamide, and 100 g of polyvinyl butyral (10 wt.% ethyl alcohol solution).

Separately, the composition (III) of Example 3 was coated on the polyester film, and dried to thereby obtain the film having thereon a layer containing therein a reducing agent.

The abovementioned heat-development type photosensitive raw material was left in a dark place for five weeks under conditions of 50° C. and a relative humidity (RH) of 80%. Thereafter, the photosensitive surface of this photosensitive raw material and the surface of the abovementioned polyester film where the composition (III) had been coated were sufficiently contacted, and then a pretreatment by heating was conducted for 3 seconds at 130° C. In continuation to this pretreatment, an image exposure was carried out for 15 seconds on this photosensitive material from the side of the polyester film through a positive image by the use of a tungsten lamp (2,500 lux), followed by the heat-development for four seconds at 130° C. by means of a roller type heating device. A visible negative print image could be obtained, which was made a specimen S-16.

For the sake of comparison, the composition (III) was coated in advance on the photosensitive layer of the abovementioned photosensitive raw material, and dried sufficiently to prepare the heat-development type photosensitive material. Subsequently, this photosensitive material was left in a dark place for five weeks under conditions of 50° C. and a relative humidity (RH) of 80%, after which the pre-treatment under heat, image exposure, and heat-development were conducted in the same way as in preparing the specimen S-16, thereby obtaining a specimen S-17.

In the same manner as in Example 1 above, comparison was made between these specimens S-16 and S-17, the results of which were favorable as shown in Table 8 below.

TABLE 8

| Specimen | Density | |
|---|---|---|
| | $D_{max}$ | $D_{min}$ |
| S-16 | 1.4 | 0.13 |
| S-17 | 0.8 | 0.32 |

EXAMPLE 12

The specimen S-1 prepared in Example 1 above and having thereon a negative visible print image was used as an electrostatic printing master, and the following operations were conducted.

A corona discharge of +7 kV was uniformly imparted to the specimen S-1 as the electrostatic printing master, after which a negatively charged toner was developed by the magnet brush developing method, whereupon a positive toner image was obtained. Then, an image transfer paper was laid over this tone image, and the abovementioned corona discharge was imparted from the side of the image transfer paper, as the result of which a visible transfer image free from the ground fogging was clearly obtained on the transfer paper.

These charging, developing and transferring operations were repeated, as the result of which it was found that, even 1,000 times and more of the image transfer operation did not reveal any deterioration on the surface of the printing master, hence there took place no undesirable disqualification of the image transferred on the transfer sheet. In this consequence, the specimen S-1 was recognized to have been excellent as the master for the respective printing operations.

Further, as the silver image exhibited faithful reproducibility to the original image, there could be formed an electrostatic charge image in correspondence to the original image, hence the toner image was recognized to have been a very faithful photographic image corresponding to the original image.

The same operations as done on the specimen S-1 were conducted on the specimen S-2 which was prepared for the sake of comparison. The resulted transfer image was found very poor in its image quality and was not suitable for practical use.

Accordingly, the heat-development type photosensitive raw material and the image forming method in Example 1 were recognized to provide a very excellent electrostatic printing master.

EXAMPLE 13

The specimens S-3, S-5, S-7, S-9, S-11, S-12, S-14, and S-16 were examined in the same way as in Example 12 above as to whether they had the performance suitable as the electrostatic printing master. Very favorable results as is the case with the specimen S-1 were obtained, and all of these specimens were recognized to have had the expected performance as the electrostatic printing master.

EXAMPLE 14

The specimen S-12 was subjected to the following operations with a view to examining whether it had the performance as the electrostatic printing master.

That is, a uniform corona discharge of +7 kV was applied to the specimen S-12 to charge the same. Subsequently, an aluminum-deposited "MYLAR" film, as an image receiving member, was brought very close to the charged surface of the master at the side where no aluminum is eveporatively deposited, but MYLAR per se constitutes the surface, i.e., the surface where the electrostatic latent image had been formed. Subsequently, the abovementioned aluminum plate and the electrically conductive rubber roller were connected each other, after which the aluminum deposited MYLAR film was peeled off along the electrically conductive rubber roller. Thereafter, this aluminum deposited MYLAR film was developed with a negatively charged toner by means of the magnet brush developing method, whereupon a positive image of a high quality which was free from the fogging, had a high density of image, and had satisfactory reproducibility in the tone adjustment. Thus, as the result of repetitive electric charging, electrostatic image transfer, and development over 1,000 times, there could be recognized not a little deterioration on the master surface, and there was no impairment in the quality of the image as developed. From the foregoing, it has become apparent that the abovementioned specimen S-12, i.e., the heat-development type photosensitive raw material and the image forming method in Example 8 could constitute a highly excellent electrostatic printing master.

EXAMPLE 15

20 g of silver behenate, 150 g of methyl ethyl ketone, and 150 g of toluene were mixed and pulverized in a ball mill for 72 hours to prepare a uniformly dispersed slurry. Subsequently, 100 g of 20% ethyl alcohol solution of polyvinyl butyral resin (produced and sold by Seikisui Chemical Co., Japan, under a trademark of "S-Lec BM-1") was added to this slurry and mixed for about 3 hours with mild agitation. Further, 0.12 g of mercury acetate, 0.2 g of calcium bromide, and 5.0 g of phthalazinone were sequentially added to the above slurry. The resulted mixture liquid was applied uniformly on an aluminum plate of 100 microns thick by the use of a coating rod, and dried for 3 minutes at 80° C.

Separately, a mixture solution composed of 1.5 g of 2,2'-methylenebis-6-t-butyl-p-cresol, 0.3 g of phthalazinone, 10 g of 10% acetone solution of cellulose acetate (under a trade mark of "DAICEL L-30"), 15 g of acetone, and 0.005 g of a sensitivity-increased coloring matter represented by the following formula:

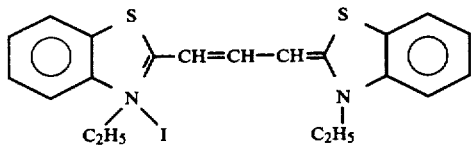

was coated on the abovementioned layer of silver behenate, and dried, thereby preparing a photosensitive sheet. The above-described operations were all done in a dark place.

The thus prepared photosensitive sheet was left for two weeks in an environment of 50° C. and 80% RH, after which exposure was conducted on one portion of this photosensitive sheet for two seconds using a tungsten lamp of 60 lux as the light source. This exposed photosensitive sheet was then subjected to the development under heat for two seconds by the use of a roller type heating device, whereupon the maximum photographic reflection density of the exposed portion was found to be 0.4 (the specimen S-18).

On the remaining portion of the photosensitive layer of this photosensitive sheet, there was further applied a solution (the composition V) composed of 1.5 g of 2,2'-methylenebis-6-t-butyl-p-cresol, 0.3 g of phthalazinone, and 15 g of acetone, which was soaked in a sponge. Then, the coated layer was dried under a natural condition. Subsequently, the exposure and the heat-development were conducted on this portion of the photosensitive sheet in the same manner as mentioned above. The maximum photographic reflection density at the exposed portion was found to be 1.5 (the specimen S-19).

Separately, the heat-development type photosensitive material coated with the abovementioned composition V was subjected to the image exposure for two seconds through a position image by the use of a tungsten lamp of 60 lux as the light source, and then subjected to the heat-development for two seconds at 130° C., thereby obtaining a negative print image. This was made the electrostatic printing master.

Next, a uniform corona discharge of −7 kV was imparted to the abovementioned plate, after which it was immersed in a liquid developer containing therein a positively charged toner, whereby a positive toner image was obtained. Then, when an image transfer paper was laid over this toner image and the abovementioned corona discharge was imparted from the side of the transfer paper, a clear visible transfer image was obtained. The electric charging, the development, and the image transfer were repeated, as the result of which it was recognized that there was no deterioration whatsoever on the surface of the photosensitive plate even when the image transfer operations extended over 1,000 times, hence no disqualification of the transferred image was recognized.

In this consequence, even with the heat-development type photosensitive material which had been placed under a very severe environment and which had become difficult to be developed, the developing property thereof could be restored by the coating of the abovementioned composition V, whereby very clear picture image was reproduced.

It was therefore concluded that, by the addition of the process step of coating the photosensitive sheet with such development accelerator as mentioned above, the latitude of the heat-development type photosensitive material toward the environmental condition, under which it had been placed, became considerably broadened.

EXAMPLE 16

The exactly same procedures as in Example 15 above were followed, with the exception that various compositions VI to XIX were prepared by varying the development accelerator. The results of measurements of the maximum photographic reflection density are as shown in the following Table 9.

TABLE 9

| Composition | Solution of Development Accelerator | | Maximum Photographic Density (reflection) |
|---|---|---|---|
| | Methyl hydroquinone | 0.3 g | |
| VI | Phthalazinone | 0.3 g | 1.8 |
| | Acetone | 15 g | |
| | 2,6-di-t-butyl-p-cresol | 1.5 g | |
| VII | Phthalazinone | 0.3 g | 1.5 |
| | Acetone | 15 g | |
| | Methylhydroxy naphthalene | 1.5 g | |
| VIII | Phthalazinone | 0.3 g | 1.3 |
| | Acetone | 15 g | |
| | Phenydone | 0.3 g | |
| IX | Phthalazinone | 0.3 g | 1.8 |
| | Acetone | 15 g | |
| | Catechol | 0.3 g | |
| X | Phthalazinone | 0.3 g | 1.9 |
| | Acetone | 15 g | |
| | Pyrrogallol | 0.3 g | |
| XI | Phthalazinone | 0.3 g | 1.9 |
| | Acetone | 15 g | |
| | p-methoxynaphthol | 1.0 g | |
| XII | Phthalazinone | 0.3 g | 1.5 |
| | Acetone | 15 g | |
| | 2,2'-methylenebis(6-t-butyl-p-cresol) | 1.5 g | |
| XIII | Phthalimide | 0.5 g | 1.5 |
| | Acetone | 15 g | |
| | 2,2'-methylenebis(6-t-butyl-p-cresol) | 1.5 g | |
| XIV | 2,3-dihydro-1,4-phthalazinone | 0.5 g | 1.3 |
| | Acetone | 15 g | |
| | 2,2'-methylenebis(6-t-butyl-p-cresol) | 1.5 g | |
| XV | 3-methyl-2-pyrazoline-5-one | 0.5 g | 1.3 |
| | Acetone | 15 g | |
| | Hydroquinone | 0.3 g | |
| XVI | Acetone | 15 g | 1.5 |
| | 2,6-di-t-butyl-p-cresol | 1.5 g | |
| XVII | Acetone | 15 g | 1.2 |
| | Phthalazinone | 0.3 g | |

TABLE 9-continued

| Composition | Solution of Development Accelerator | | Maximum Photographic Density (reflection) |
|---|---|---|---|
| XVIII | Acetone | 15 g | 1.1 |
| | Phthalimide | 0.3 g | |
| XIX | Acetone | 15 g | 1.0 |

EXAMPLE 17

40 g of a mixture of slver behenate and behenic acid in equivalent mol ratio, 150 g of toluene, and 150 g of acetone were mixed and pulverized in a ball mill for 72 hours to prepare a uniformly dispersed slurry. Then, 200 g of 10% ethyl alcohol solution of polyvinyl butyral resin was added to this slurry and mixed for about three hours with mild agitation.

Subsequently, 0.06 g of mercury acetate, 0.2 g of calcium bromide, and 50 g of phthalazinone were sequentially added to obtain a slurry mixture. The slurry was then uniformly coated on paper which had been subjected to the electric conduction treatment, and dried. Next, a separate mixture solution composed of 2.0 g of 2,6-di-t-butyl-p-cresol, 0.3 g of phthalazinone, 10 g of 10% acetone solution of cellulose acetate (under a trademark "DAICEL L-30"), 15 g of acetone, and 0.002 g of Victoria blue as the sensitivity-increased coloring matter, and 0.005 g of a compound represented by the following formula:

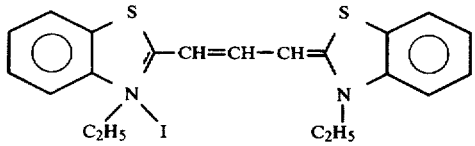

was coated on the abovementioned layer of silver behenate.

The thus obtained heat-development type photosensitive material (photosensitive sheet) was left for two weeks in an environment of 50° C. and 80% RH, after which an image-exposure was conducted for two seconds using a tungsten lamp of 60 lux as the light source.

Subsequently, a solution (composition XX) containing therein a development accelerator consisting of 1.5 g of 2,2'-methylenebis(6-t-butyl-p-cresol), 0.3 g of phthalazinone, and 15 g of acetone was soaked in a sponge roller, and then applied onto the surface of the abovementioned photosensitive material, followed by drying under a natural condition. The photosensitive material was then subjected to the development under heat for two seconds at 130° C. by the use of a roller type heating device, whereupon the reflection density of the exposed portion thereof became 1.5. However, when the composition XX was not coated on the photosensitive material surface, the reflection density of the exposed portion was 0.35.

Also, when a negative silver image was formed in accordance with the conventional method by using a portion of the abovementioned photosensitive sheet, and then a positive corona charge was uniformly applied onto this negative image master, there was obtained an electrostatic latent image having a positive surface charge. Then, when a negatively charged toner was applied to this electrostatic latent image by means of the magnet brush developing method, and the image transfer operation was conducted by imparting the corona discharge thereto from the side of the transfer paper, a very clear visible image free from fogging was obtained. The transfer image was then fixed by the use of a heater at 100° C. It was observed that, even when the reproduction operation was repeated over 1,000 times, the quality of the transfer image was not lowered.

EXAMPLE 18

A sheet of benzotriazole silver was formed in the same manner as in Example 17, with the exception that benzotriazole silver was used in place of a mixture of silver behenate and behenic acid in equivalent mol ratio.

Onto this benzotriazole silver layer, there was coated a mixture liquid composed of 1.5 g of 2,2'-methylenebis-6-t-butyl-p-cresol, 0.5 g of phthalimide, 10 g of 10% acetone solution of cellulose acetate (under a trademark of "DAICEL L-30"), and 15 g of acetone, thereby obtaining the photosensitive sheet.

This photosensitive sheet was left for two weeks in a dark place in an environment of 50° C. and 80% RH, after which the same composition XX was coated thereon in the same manner as in Example 17. Then, a negative silver image was formed on this photosensitive sheet, followed by the electric charging, the development, the image-transfer, and the image fixation as in the case with Example 17, whereby a clear visible image free from the fogging was obtained.

EXAMPLE 19

The photosensitive sheet obtained in Example 15 was left for two weeks in an environment of 50° C. and 80% RH, after which it was subjected to an image exposure for two seconds by the use of a tungsten lamp of 60 lux as the exposure light source.

Separately, a sheet was prepared by coating a paper substrate with a solution composed of 0.3 g of hydroquinone, 0.3 g of phthalazinone, 10 g of acetone, and 5 g of ethyl cellulose (15% ethyl acetate solution) by means of a coating rod #24. This coated sheet was overlaid at its coated surface on the abovementioned exposed photosensitive sheet, followed by heat treatment for two seconds at 130° C., whereupon the maximum photographic reflection density became 1.3.

EXAMPLE 20

10 g of silver behenate, 150 g of methyl ethyl ketone, 150 g of toluene, and 3 g of silica powder (a product of Fuji Davison Chemical Ltd., Japan under a trademark of "SYLOID #24") were mixed and uniformly dispersed in a ball mill for 72 hours.

Thereafter, 100 g of 10% ethanol solution of polyvinyl butyral was added to the abovementioned mixture to make it a uniform slurry. By the use of a coating rod, this slurry was applied onto art paper of a thickness of 70 microns to a coating thickness of 8 microns (after drying), and then dried.

Separately, a mixture solution prepared by dissolving 1 g of 2,6-di-t-butyl-p-cresol, 0.5 g of phthalazinone, 1 g of cellulose acetate, and 0.005 g of ammonium bromide into 20 g of acetate was applied onto the abovementioned silver behenate layer to a coating thickness of 4 microns (after drying).

The thus prepared sheets were left in a dark place for different time periods, respectively. That is, the sheet which was left in the dark place for a single day was designated as a sample $S_1$-20, the sheet left for 30 days was designated as a sample $S_{30}$-20, and the sheet left for 10 days in an environment of 50° C. and 80% RH was designated as $S_{10}$-20. These specimen sheets were then illuminated for 10 seconds with a tungsten lamp of 100W which was set 30 cm distant from the sheet, after which it was subjected to the development under heat by a roller type heat development device (at 130° C.). When the measurement were conducted as to the maximum density ($D_{max}$) and the fog density ($D_{min}$), the results as shown in Table 10 below were obtained. In other words, the developing property of the sheets became lowered with lapse of time.

When a liquid prepared by dissolving 100 mg of diethyl sodium dithiocarbamate into 50 ml of ethyl alcohol was soaked in a sponge roller, and coated on the abovementioned sheet, the developing property thereof was restored as shown in Table 11 below, whereby the sheet became to have the characteristic which is substantially comparable to that at the time of its preparation.

TABLE 10

| Development | $S_1$-20 | | $S_{30}$-20 | | $S_{10}$-20 | |
|---|---|---|---|---|---|---|
| Time | $D_{max}$ | $D_{min}$ | $D_{max}$ | $D_{min}$ | $D_{max}$ | $D_{min}$ |
| 1 sec | 0.20 | 0.10 | 0.10 | 0.10 | 0.10 | 0.10 |
| 2 sec | 0.65 | 0.10 | 0.20 | 0.10 | 0.15 | 0.10 |
| 3 sec | 1.10 | 0.20 | 0.35 | 0.10 | 0.25 | 0.10 |
| 4 sec | 1.15 | 0.20 | 0.60 | 0.13 | 0.37 | 0.12 |
| 5 sec | 1.20 | 0.20 | 0.80 | 0.15 | 0.50 | 0.14 |

TABLE 11

| Development | $S_1$-20 | | $S_{30}$-20 | | $S_{10}$-20 | |
|---|---|---|---|---|---|---|
| Time | $D_{max}$ | $D_{min}$ | $D_{max}$ | $D_{min}$ | $D_{max}$ | $D_{min}$ |
| 1 sec | 0.30 | 0.10 | 0.20 | 0.10 | 0.20 | 0.10 |
| 2 sec | 0.70 | 0.10 | 0.63 | 0.10 | 0.60 | 0.10 |
| 3 sec | 1.20 | 0.20 | 1.10 | 0.15 | 1.05 | 0.15 |
| 4 sec | 1.30 | 0.20 | 1.14 | 0.20 | 1.10 | 0.20 |
| 5 sec | 1.40 | 0.20 | 1.20 | 0.20 | 1.15 | 0.20 |

What is claimed is:

1. In the process for forming a negative silver image employing a dry silver photosensitive member by imagewise exposing said member to form a latent silver image and heat developing the latent silver image to form a negative silver image, said photosensitive member having a tendency to deteriorate in image-forming ability upon storage, the improvement comprising in sequence:

(a) forming a photosensitive member comprising an organic silver salt, a halide and a binder, (b) storing said photosensitive member prior to use for at least about several weeks and thereafter (c) adding a reducing agent to said member to foster heat development during a period from prior to image exposing to simultaneously with heat-developing.

2. In the process for preparing an electrostatic printing master from a photosensitive member comprising imagewise exposing said photosensitive member to form a latent silver image, heat developing the latent silver image to form a negative silver image, said photosensitive member having a tendency to deteriorate in image-forming ability upon storage, the improvement comprising in sequence:

(a) forming a photosensitive member comprising an organic silver salt, a halide and a binder, (b) storing said photosensitive member prior to use for at least about several weeks and thereafter (c) adding a reducing agent to said member to foster heat development during a period from prior to image exposing to simultaneously with heat-developing.

3. The image forming method as claimed in either of claim 1 or claim 2 wherein the reducing agent is applied by means of a coating method.

4. The product produced by the process of claim 1.

5. The product of claim 4 wherein the binder is electrically insulative and the developed member is employed as an electrostatic printing master.

* * * * *